US011066226B2

(12) United States Patent
Marotta

(10) Patent No.: US 11,066,226 B2
(45) Date of Patent: Jul. 20, 2021

(54) SHIPPING CONTAINER

(71) Applicant: DRYCE S.R.L., Cernusco sul Naviglio (IT)

(72) Inventor: Carmine Marotta, Naples (IT)

(73) Assignee: DRYCE S.R.L., Cernusco sul Naviglio (IT)

( * ) Notice: Subject to any disclaimer, the term of this patent is extended or adjusted under 35 U.S.C. 154(b) by 331 days.

(21) Appl. No.: 16/342,075

(22) PCT Filed: Oct. 4, 2017

(86) PCT No.: PCT/IB2017/056108
§ 371 (c)(1),
(2) Date: Apr. 15, 2019

(87) PCT Pub. No.: WO2018/078468
PCT Pub. Date: May 3, 2018

(65) Prior Publication Data

US 2019/0248562 A1 Aug. 15, 2019

(30) Foreign Application Priority Data

Oct. 24, 2016 (IT) ..... 102016000106811

(51) Int. Cl.
*B65D 81/07* (2006.01)
*B65D 81/02* (2006.01)
*B65D 85/30* (2006.01)

(52) U.S. Cl.
CPC ..... *B65D 81/07* (2013.01); *B65D 81/02* (2013.01); *B65D 85/30* (2013.01)

(58) Field of Classification Search
None
See application file for complete search history.

(56) References Cited

U.S. PATENT DOCUMENTS 3,265,200 A 8/1966 Omer
3,656,649 A 4/1972 Martin
4,919,300 A 4/1990 Anderson et al.
(Continued)

FOREIGN PATENT DOCUMENTS

DE 950058 C 10/1956
FR 585827 A 3/1925
(Continued)

OTHER PUBLICATIONS

International Search Report and Written Opinion for Corresponding International Application No. PCT/IB2017/056108 (15 Pages) (dated Dec. 21, 2017).

*Primary Examiner* — Mollie Impink
(74) *Attorney, Agent, or Firm* — Lucas & Mercanti, LLP

(57) ABSTRACT

A shipping container is disclosed having a body wherein a cavity is formed, a lid adapted to close a top of the body and a support configured as a gimbal. The gimbal support has an outer cage configured to be fitted in the cavity and sized so as to contact the walls of the cavity, an inner cage restrained to the outer cage and rotatable relative thereto about at least one first rotation axis (A) and a cradle restrained to the inner cage and rotatable relative to the outer cage about at least one second rotation axis (B) perpendicular to the first rotation axis (A), the cradle being configured to receive and hold one or more objects.

8 Claims, 5 Drawing Sheets

(56) References Cited

U.S. PATENT DOCUMENTS

| | | | | | |
|---|---|---|---|---|---|
| 5,287,969 | A * | 2/1994 | Kehr | ..... | B65D 81/02<br>119/52.2 |
| 6,490,880 | B1 | 12/2002 | Walsh | | |
| 2005/0239190 | A1 * | 10/2005 | Poo | ..... | B65D 81/20<br>435/284.1 |

FOREIGN PATENT DOCUMENTS

| | | | | | |
|---|---|---|---|---|---|
| GB | 277370 | A * | 12/1927 | ..... | B65D 81/07 |
| WO | 2004037653 | A2 | 5/2004 | | |

* cited by examiner

SHIPPING CONTAINER

CROSS-REFERENCE TO RELATED APPLICATIONS

This application is a 371 of PCT/IB2017/056108, filed Oct. 4, 2017, which claims the benefit of Italian Patent Application No. 102016000106811, filed Oct. 24, 2016.

FIELD OF THE INVENTION

The present invention generally relates to the field of shipping containers and in particular to a container of the type comprising a gimbal support suitable to maintain the upright or vertical position of an object to be transported.

BACKGROUND OF THE INVENTION

In the field of containers for shipping of fragile and/or delicate objects, such as medical products intended, it is known to arrange shock absorbers in a container around the objects to be transported so as to reduce the adverse effects of vibrations and any impacts.

Also known are shipping containers comprising a gimbal support, wherein the support is not only suitable to protect goods but also to maintain them in an upright position regardless of the position the container can assume with respect to a horizontal plane during its transport to destination.

In a shipping container comprising a gimbal support the goods are arranged on a cradle and the center of gravity of the group of components forming the gimbal lies below all its rotation axes relative to a vertical direction along which the force of gravity acts, so that the goods arranged on the cradle tend to stay upright.

An example of such a container is described in U.S. Pat. No. 3,656,649.

U.S. Pat. Nos. 3,265,200 A and 6,490,880 B1 describe shipping containers according to the preamble of independent claim 1.

SUMMARY OF THE INVENTION

Despite the existence of containers comprising gimbal supports, there is still a need to simplify and improve the structure of the latter and to increase the protection level for the goods, which is an object of the present invention.

Said object is achieved by a shipping container whose main features are specified in the independent claims, while other features are specified in the remaining claims.

An idea of solution underlying the invention is to make a shipping container comprising a hollow body and a support configured as a gimbal that can be removably fitted into the hollow body. The support comprises an outer cage sized so as to contact the walls of the cavity of the body and an inner cage restrained to the outer cage and rotatable relative to it about at least a first rotation axis. The support also comprises a cradle restrained to the inner cage and rotatable relative to the outer cage around at least a second rotation axis perpendicular to the first rotation axis. The cradle is configured to receive and hold one or more objects.

The outer cage of the cradle protects the objects arranged on the cradle from impacts and vibrations acting on the container, while the inner cage and the cradle allow to maintain the upright position of the objects arranged on the cradle regardless of the position of the outer cage, and therefore the position of gimbal support and container relative to a horizontal plane.

According to a first embodiment of the invention, the cradle comprises a base serving as a ballast and a pair of arms arranged along its periphery opposite to each other relative to a central portion thereof, said arms extending perpendicularly from the base and being pivoted on the inner cage by way of respective pins that define the second rotation axis.

According to another embodiment of the invention, the outer cage of the support is made up of two frames that can be mounted atop of each other and are generally sized so as to contact the walls of the body cavity of the container. Each frame comprises a hemispherical hollow shell whose cavity faces the surface intended to come into contact with the other frame, so that the two hemispherical shells form a hollow spherical body in a assembled configuration of the support.

The spherical hollow body houses an inner cage, which in turn consists of a spherical body comprising two hollow hemispherical elements that can be removably assembled with each other, between which one or more objects to be transported can be arranged and possibly held by suitably shaped members.

The inner cage, which also performs the function of a cradle, is supported in the spherical hollow body made by sliding surfaces made of a low friction material.

This embodiment of the gimbal support is very compact and offers a higher protection to the transported objects because not only the first cage but also the second cage have a closed configuration.

BRIEF DESCRIPTION OF THE DRAWINGS

Further advantages and features of the shipping container according to the present invention will be clear to those skilled in the art from the following detailed and non-limiting description of embodiments thereof, with reference to the accompanying drawings in which.

DETAILED DESCRIPTION OF THE INVENTION

Figure 1:
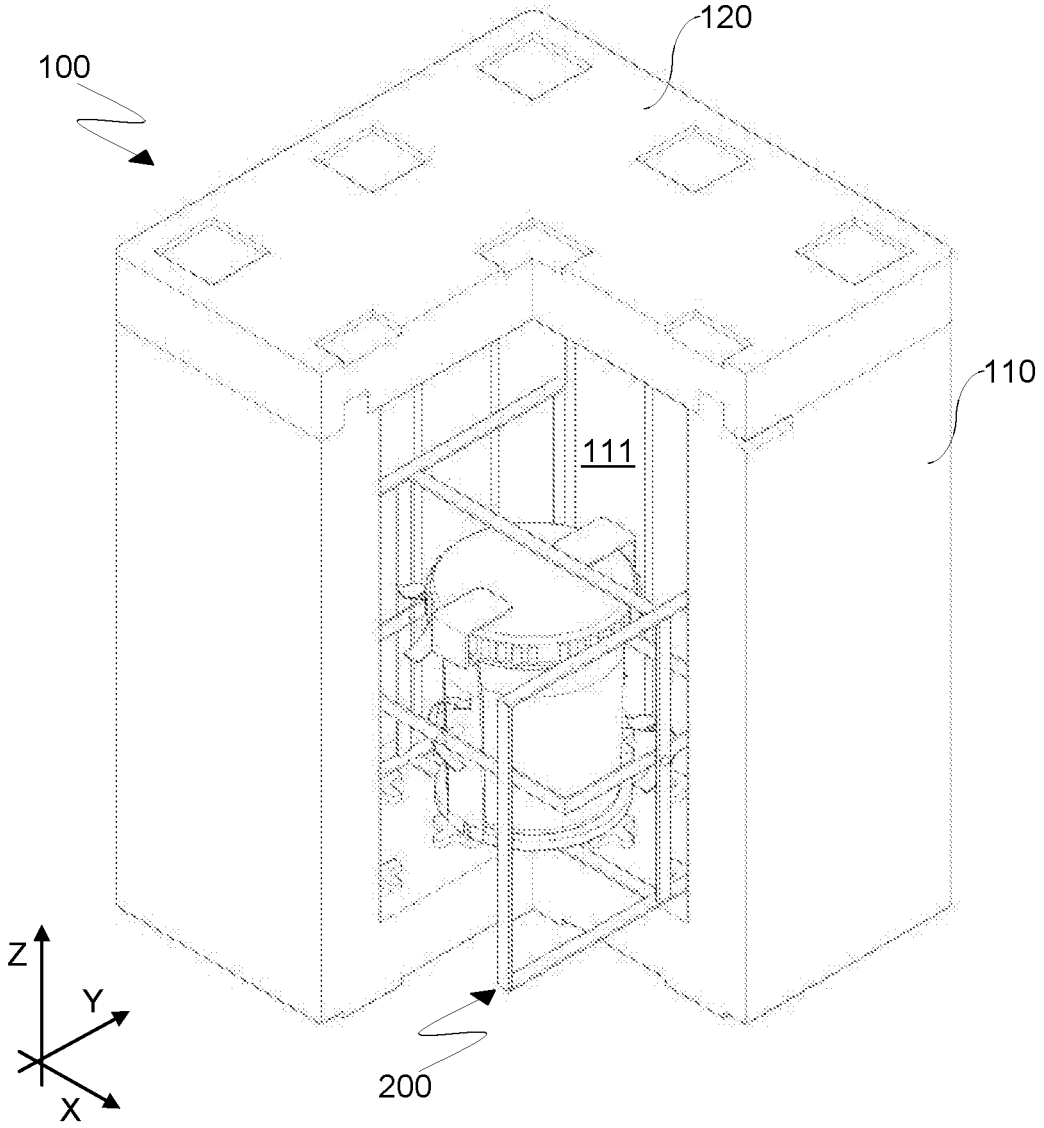
FIG. 1 is a perspective, partially broken view showing a shipping container according to a first embodiment of the invention and a gimbal support housed inside it.
Figure 2:
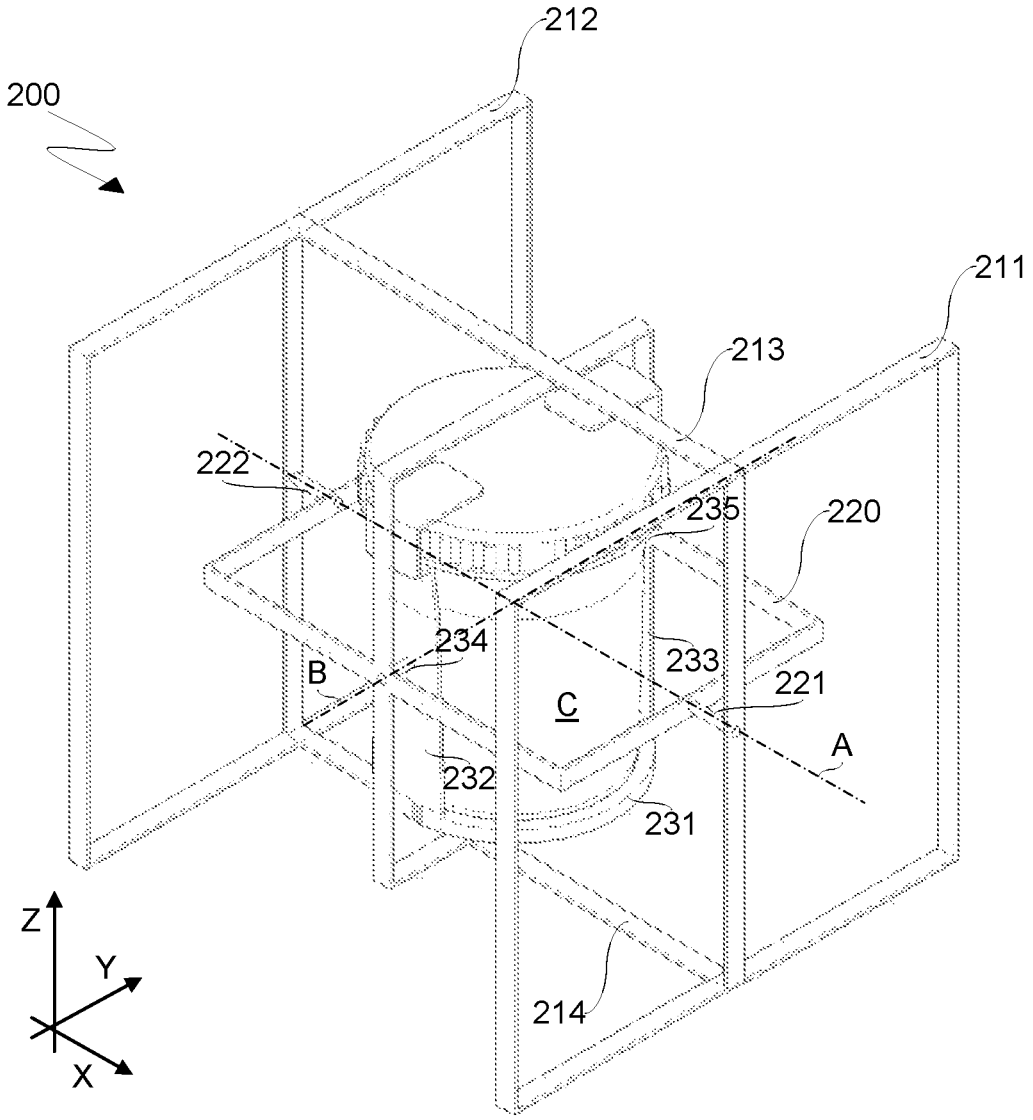
FIG. 2 is a perspective view of the gimbal support of the container of FIG. 1.
Figure 3:
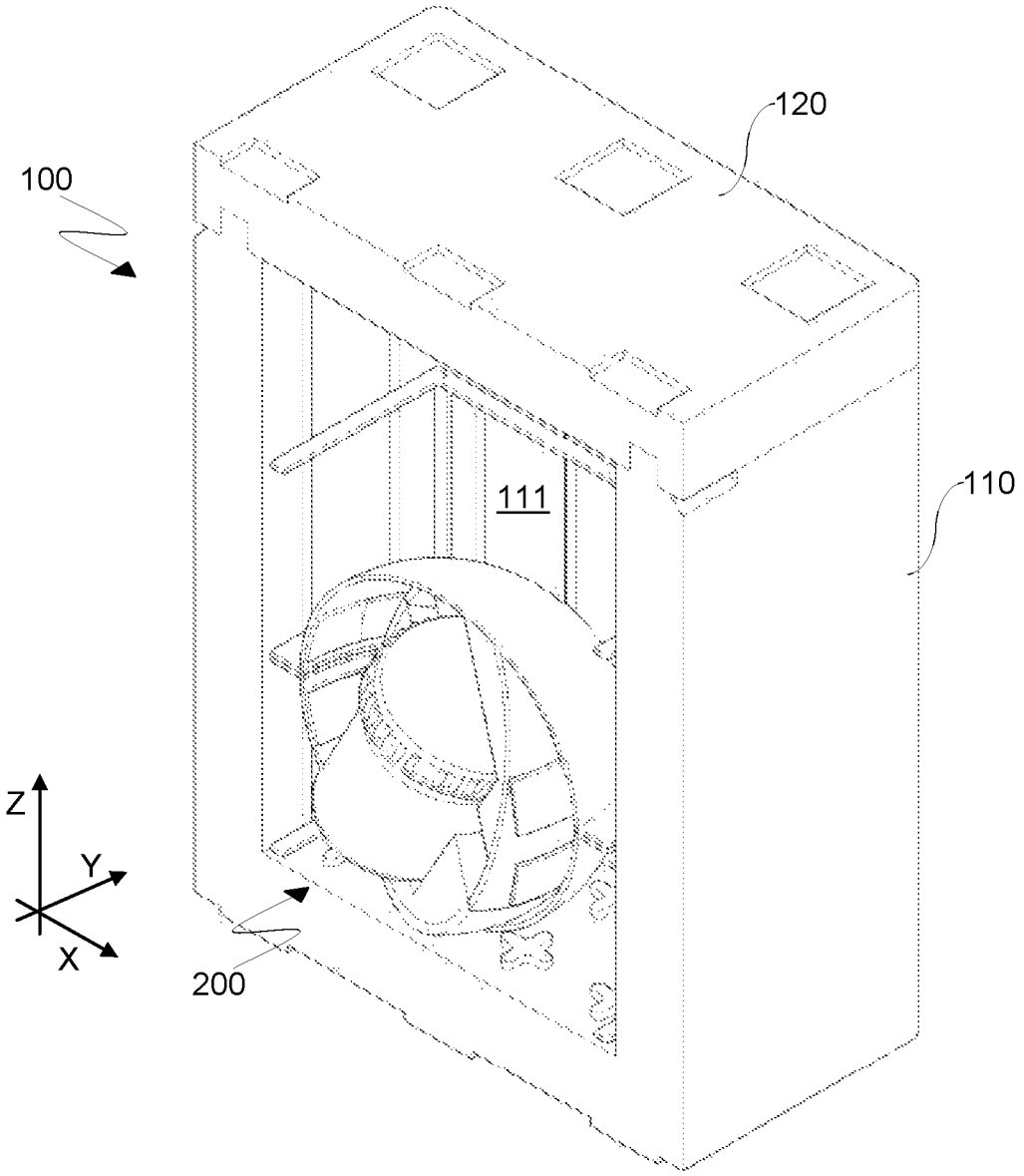
FIG. 3 is a perspective, partially broken view showing a shipping container according to a variant of the invention and a gimbal support housed inside it.
Figure 4:
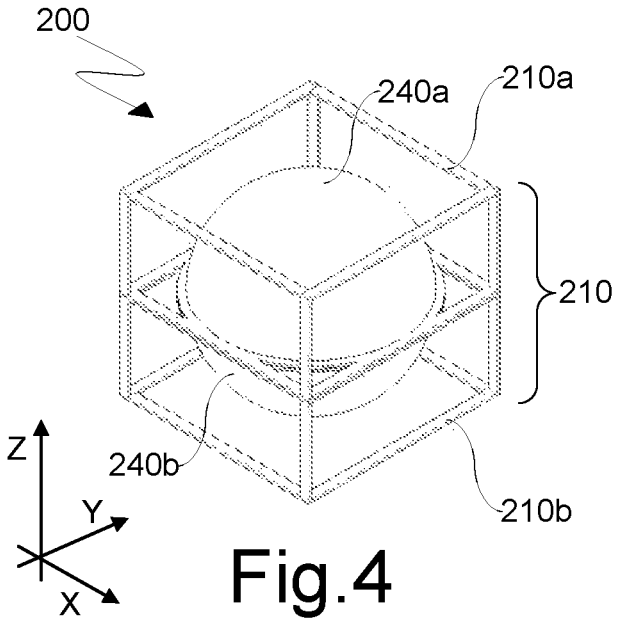
FIG. 4 is a perspective view of the gimbal support of the container of FIG. 3.
Figure 5:
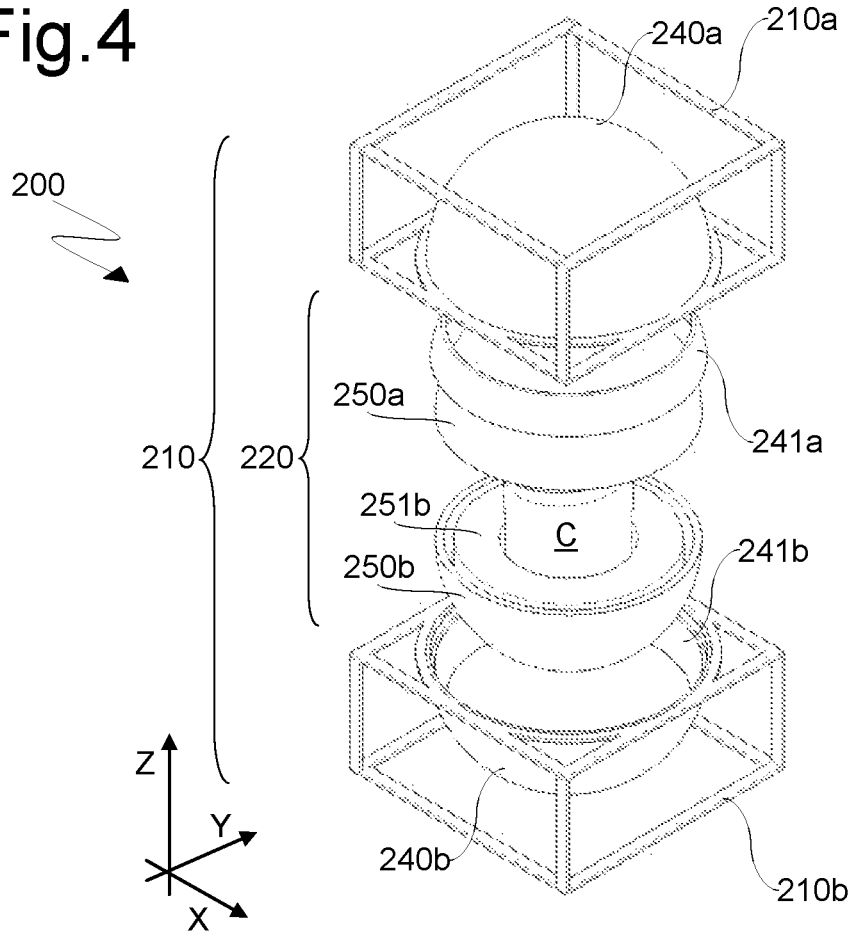
FIG. 5 is an perspective, exploded view of the gimbal support of the container of FIG. 3.
Figure 6:
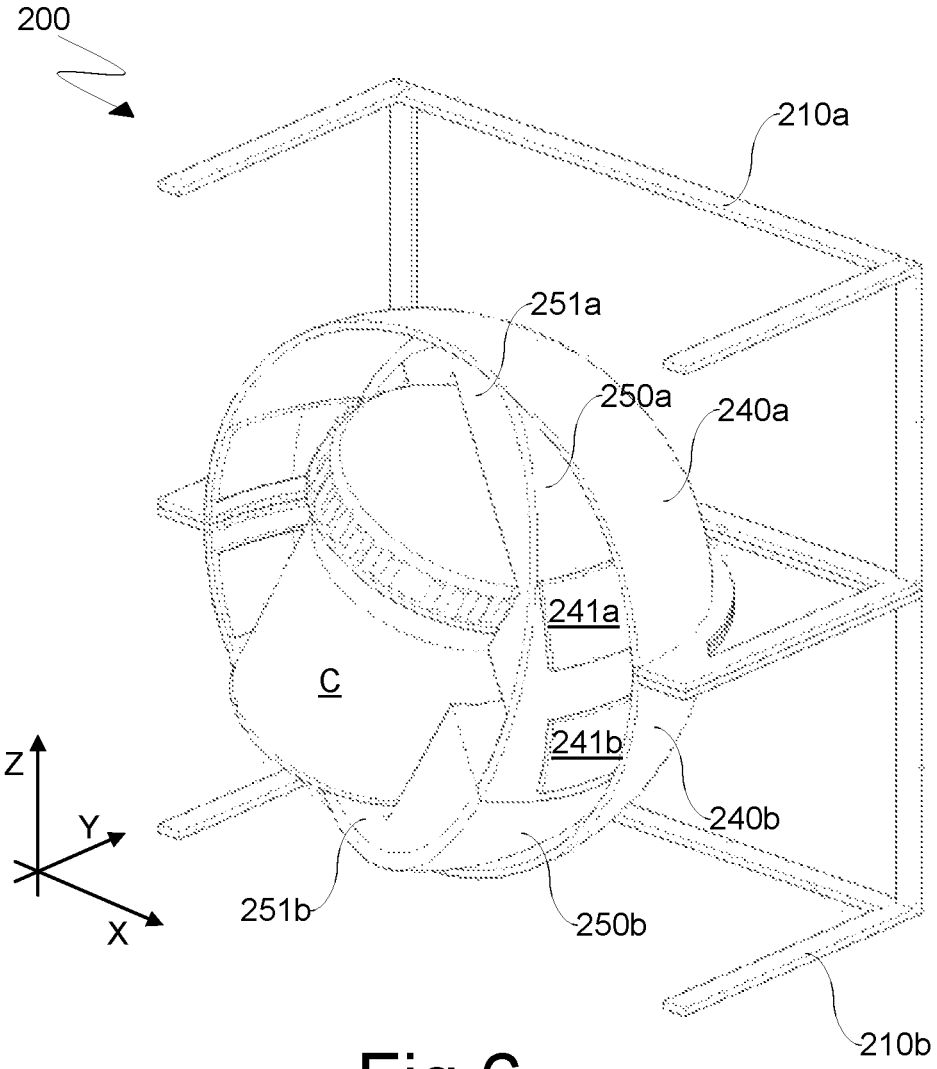
FIG. 6 is a perspective, cross sectional view of the gimbal support of the container of FIG. 3.

Referring initially to FIGS. 1 and 2, a first embodiment of the invention is disclosed. A shipping container according to the invention is generally indicated by reference numeral 100 and is shown in a three-dimensional reference system wherein a first direction X and a second direction Y that are mutually perpendicular define a horizontal plane, and a third direction Z is a direction perpendicular to the horizontal plane along which the force of gravity acts.

The container 100, e.g. made of expanded polystyrene, comprises in a known manner a body 110 defining inside it a cavity 111 that is intended to contain one or more objects to be transported. The container 100 also comprises a lid 120 configured to close the top of the body 110.

The container 100 further comprises a support configured as a gimbal. The gimbal support is generally indicated by reference number 200.

The support 200 comprises an outer cage 210 so sized as to contact the walls of the cavity 111 of the body 110 of the container 100 and an inner cage 220 restrained to the outer cage rotatably about at least a first rotation axis A parallel to the horizontal plane XY.

The support 200 also comprises a cradle 230 restrained to the inner cage 220 and rotatable about at least a second rotation axis B that is parallel to the horizontal plane XY and is perpendicular to the first rotation axis A. The cradle 230 is configured to receive and hold one or more objects.

As indicated above, the outer cage 210 is sized so as to contact the walls of the cavity 111 of the body 110 of the container 100 and its function is to protect the objects arranged on the cradle 230 from shocks and vibrations acting on the container 100.

The function of the inner cage 220 and of the cradle 230 is instead to allow to maintain upright the objects arranged on the latter regardless of the position of the outer cage 210, and hence of the support 200 and the container 100, with respect to a horizontal plane.

In the embodiment shown in FIGS. 1 and 2, the outer cage 210 of the support 200 has for example two shoulders 211, 212 that are spaced from one another and are restrained to each other by way of cross members 213, 214.

As shown in FIG. 2, the shoulders 211, 212 are for example in the form of frames consisting of bars made e.g. of a metal material and that e.g. lie on planes parallel to the plane YZ. The cross members 213, 214 also consist of metal bars, but lie on planes parallel to the XY plane.

The inner cage 220 of the support 200 is made up of a frame consisting of bars made, for example, of a metal material. The frame is rotatably restrained to the outer cage 210 by way of two pins 221, 222 which are fixed to respective bars of the latter and define the first rotation axis A.

The cradle 230 comprises a base 231 and a pair of arms 232, 233 disposed along its periphery opposite to each other relative to a central portion of the base 231, for example diametrically opposed in case the base 231 has a circular shape such as in the illustrated example. The arms 232, 233 extend perpendicularly to the base 231 and are pivoted on the inner cage 220 at respective pins 234, 235 that define the second rotation axis B.

The gimbal support according to this embodiment of the invention thus has two degrees of freedom. It will be appreciated that the overall configuration of the cradle 230 is such that its base 231 acts as a counterweight or ballast, allowing to maintain the upright position of the objects arranged thereon regardless of the position of the outer cage 210 relative to a horizontal plane.

The arms 232, 233 are shaped so as to block one or more objects on the base 231. For example, if the support 200 is provided with a container C intended to contain one or more objects to be carried, the arms 232, 233 may be advantageously bent one towards the other thus forming suitable anchoring members adapted to receive and hold a lid of container C.

Now referring to FIGS. 3 to 6, another embodiment of the invention is disclosed.

According to this embodiment, the outer cage 210 of the support 200 is made up of two frames 210*a*, 210*b* that can be put atop of each other and that are generally sized so as to contact the walls of the cavity 111 of the body 110 of the container 100.

The two frames 210*a*, 210*b* forming the outer cage 210 are for example made up of metal bars.

Each frame 210*a*, 210*b* comprises a hemispherical hollow shell 240*a*, 240*b* whose cavity faces the surface intended to come into contact with the other frame. In the assembled configuration of the support 200 shown in FIG. 4, the two hemispheric shells 240*a*, 240*b* thus define a hollow spherical body.

The two hemispheric hollow shells 240*a*, 240*b* are arranged at a central position of the respective frames, so that the spherical body is generally arranged at a central position of the outer cage 210 of the support 200 in its operational configuration.

Each hemispheric hollow shell 240*a*, 240*b* comprises at least one sliding surface 241*a*, 241*b* arranged inside it and made of a low friction material, for example PTFE. In the illustrated embodiment, the sliding surfaces 241*a*, 241*b* are arranged e.g. close to the peripheral edges of the cavities of the respective hemispheric shells 240*a*, 240*b* and have for example an annular shape.

The inner cage 220 is made up of a spherical body comprising two hemispherical members 250*a*, 250*b* which can be assembled with each other in a removable manner by known means, for example, snap fit, screwing, press fit and the like.

The hemispherical members 250*a*, 250*b* are made of a low friction material, such as mirror polished steel, so that in an assembled configuration of the support 200, the inner cage 220 may rotate relative to the outer cage 210 with respect to at least two mutually perpendicular axes, i.e. at least a first axis A and at least a second axis B as in the first embodiment disclosed above.

Therefore it will be appreciated that also this embodiment of the invention has a gimbal support 200.

It will also be appreciated that unlike the first embodiment disclosed above, the inner cage 220 and the cradle 230 of the gimbal support are integrally formed with each other and can rotate about a first axis A or a second axis B that are perpendicular to each other and both parallel to the horizontal plane XY, as well as about a third axis perpendicular to that plane.

Compared to the first embodiment, the gimbal support has in this case three degrees of freedom.

In the cavity of the hemispherical element intended to be arranged at a lower position relative to the vertical direction Z a mass (not shown) acting as a counterweight or ballast for the gimbal is arranged.

The cavities of the two hemispheric cables 250*a*, 250*b* may also house shaped pieces 251*a*, 251*b* configured to receive and maintain in an upright position one or more objects to be transported, or, as in the illustrated example, a container C configured to receive and store these objects. One of the two shaped pieces 251*a*, 251*b* can be made of a material heavier than the other one, thus serving as a counterweight or ballast for the gimbal support. The materials of which the shaped pieces 251*a*, 251*b* are made may be thermally insulating materials.

Shaped pieces made of a thermally insulating material, such as expanded polystyrene, expanded polyurethane or expanded polypropylene, may be advantageously arranged between the container 100 and the support 200. Alternatively or in addition to this vacuum cavities may be foreseen.

The invention has been disclosed herein with reference to preferred embodiments thereof. It will be appreciated that there further embodiments may exist relating to the same inventive idea, all of which lie within the scope of protection defined by the claims set out below.

The invention claimed is:

1. A shipping container comprising:

a body wherein a cavity is formed;

a lid adapted to close a top of said body;

a support configured as a gimbal, wherein said support comprises:

an outer cage configured to be fitted in said cavity and sized so as to contact walls of the cavity, an inner cage restrained to said outer cage and rotatable relative thereto about at least one first rotation axis (A); and a cradle restrained to said inner cage and rotatable relative to the outer cage about at least one second rotation axis (B) perpendicular to said first rotation axis (A), said cradle being configured to receive and hold one or more objects, wherein the cradle comprises a base acting as a ballast and a pair of arms that are arranged along its periphery in opposite positions with respect to a central portion thereof, said arms extending perpendicularly from the base and being pivoted on the inner cage by way of respective pins that define the second rotation axis (B).

2. The container according to claim 1, wherein the outer cage of the support comprises two shoulders that are mutually spaced apart and are connected by way of cross members, and wherein the inner cage of the support is made up of a frame rotatably restrained between said shoulders by way of two pins that define the first rotation axis (A).

3. The container according to claim 1, wherein the arms of the cradle are so shaped as to allow to receive and hold one or more objects arranged on the base.

4. The container according to claim 1, further comprising a container (C) intended to contain one or more objects to be transported, said container (C) being so sized as to be arranged on the base of the cradle and held by its arms.

5. A shipping container comprising:

a body wherein a cavity is formed;

a lid adapted to close a top of said body;

a support configured as a gimbal, wherein said support comprises:

an outer cage configured to be fitted in said cavity and sized so as to contact walls of the cavity, and an inner cage restrained to said outer cage, wherein the outer cage of the support is made up of two frames arranged on top of each other and that are so sized as to contact the walls of the cavity of the body of the container, wherein each frame comprises a surface intended to contact the other frame and a hemispherical hollow shell having a cavity, the cavity of the hemispherical hollow shell faces the surface of the frame intended to contact the other frame, and wherein each hemispherical hollow shell comprises a sliding surface made of a low friction material, and wherein the inner cage is made up of a spherical body comprising two hemispherical hollow members that can be assembled with each other in a removable manner, and wherein said hemispherical hollow members are made of a low friction material, the hemispherical hollow member intended to be arranged at a lower position inside the container with respect to a vertical direction (Z) thereof, the hollow member housing a mass acting as a ballast for the gimbal support.

6. The container according to claim 5, wherein said sliding surfaces are arranged close to a peripheral edge of the cavities of the respective hollow hemispherical shells and have an annular shape.

7. The container according to claim 5, wherein the cavities of the two hemispherical hollow members forming the inner cage house shaped pieces so configured as to receive and hold one or more objects in a predefined position.

8. The container according to claim 7, wherein said shaped pieces are configured to receive and hold a container (C).

* * * * *